US005776866A

United States Patent [19]

Karaki et al.

[11] Patent Number: 5,776,866

[45] Date of Patent: Jul. 7, 1998

[54] PARTING AGENT FOR DIE-CASTING

[75] Inventors: Mithuhiro Karaki, Okazaki; Mikiya Nozaki, Toyota; Masato Hakoiwa, Yōkaichiba; Toshiaki Midorikawa, Katori-gun, all of Japan

[73] Assignees: Toyota Jidosha Kabushiki Kaisha, Toyota; Hitachi Powdered Metals Co., Ltd., Matsudo, both of Japan

[21] Appl. No.: 729,506

[22] Filed: Oct. 11, 1996

[30] Foreign Application Priority Data

Oct. 12, 1995 [JP] Japan ..... 7-264368

[51] Int. Cl.[6] ..... C10M 111/00; B22C 3/00

[52] U.S. Cl. ..... 508/122; 508/128; 508/130; 508/155; 508/175; 508/179

[58] Field of Search ..... 508/122, 128, 508/130, 155, 175, 179

[56] References Cited

U.S. PATENT DOCUMENTS

| | | | |
|---|---|---|---|
| 1,811,610 | 6/1931 | Carlile . | |
| 3,341,454 | 9/1967 | Chor, Jr. | 508/121 |
| 3,836,372 | 9/1974 | Horton | 106/38.22 |
| 4,195,002 | 3/1980 | Radtke et al. | 508/155 |
| 5,076,339 | 12/1991 | Smith | 508/120 |
| 5,279,749 | 1/1994 | Hanano | 508/155 |
| 5,388,631 | 2/1995 | Suganuma et al. . | |
| 5,401,801 | 3/1995 | Naganawa et al. | 524/745 |

FOREIGN PATENT DOCUMENTS

| | | | |
|---|---|---|---|
| 0 550 028 A1 | 7/1993 | European Pat. Off. . | |
| 0 697 262 A1 | 2/1996 | European Pat. Off. . | |
| 1 608 759 | 12/1970 | Germany . | |
| 63-265996 | 11/1988 | Japan . | |
| 64-053727 | 3/1989 | Japan . | |
| 6-015406 | 1/1994 | Japan . | |
| 6-122057 | 5/1994 | Japan | 164/72 |
| 753523 | 8/1980 | U.S.S.R. | 164/72 |
| 2 003 922 A | 3/1979 | United Kingdom . | |

*Primary Examiner*—Jacqueline V. Howard
*Attorney, Agent, or Firm*—Cushman Darby Cushman IP Group of Pillsbury Madison & Sutro LLP

[57] ABSTRACT

A parting agent capable of being applied to a die with split die members closed, and preventing the production of defective castings and the occurrence of heat shock as well as the precipitation of a solid lubricant. The parting agent is composed of a mixture of a parting component, a dispersing component for dispersing the paritng component through water, a surface active agent as a foaming agent, and water, and is foamed into a foamy state. The foamy parting agent can be applied to the die with the split die members closed. This overcomes problems caused by the scattering of the parting agent due to spraying. In addition, since the parting component is retained with a film defining foam, the separation and precipitation thereof can be prevented.

12 Claims, 1 Drawing Sheet

PARTING AGENT FOR DIE-CASTING

BACKGROUND OF THE INVENTION

1. Field of the Invention

The present invention relates to a composition of a parting agent adapted to be used in a die-casting method and, more particularly, to a composition of a unique foamy parting agent.

2. Description of Related Art

In a die-casting method such as an aluminum die-casting method, to cool a die and improve the partition properties of castings from the die, walls of the die are coated with a water-type parting agent prior to injecting molten metal.

In the die-casting method of injecting molten metal at a low rate, for example, there has been used a parting agent wherein particles of a solid lubricant such as graphite, talc, sericite, boron nitride or fluorocarbon resin (PTFE) are dispersed through water containing a dispersing agent such as carboxymethylcellulose.

In the die-casting method of injecting molten metal at a high rate, there has been used another parting agent wherein oils and fats are emulsified and dispersed through water containing an emulsifier such as polyoxyethylene alkylallyl ether.

Japanese Unexamined Patent Publication (KOKAI) No. 63-265996, for example, discloses a parting agent including 100 parts by weight of silicone oil, 10–100 parts by weight of hydrocaron liquid polymer, 10–100 parts by weight of natural wax, 10–50 parts by weight of a surface active agent and 1–20 parts by weight of a solid lubricant.

Japanese Unexamined Patent Publication (KOKAI) No. 64-53727 discloses a water-type parting agent including copolymer of ethylene and propylene adducted by meleic acid anhydride, a surface active agent and water as essential ingredients, and Japanese Unexamined Patent Publication (KOKAI) No. 6-15406 discloses a parting agent including porous synthetic silicate having a specific surface area of 40 $m^2/g$ or more, which is suspended in water containing a dispersing agent.

To apply the above-described conventional parting agents to a die, they have been respectively diluted with water to a suitable concentration, and sprayed on die walls by a spray device provided between facing split die members of the die opened. Upon spraying, these parting agents, however, have scattered and stuck to contacting surfaces of the split die members. Due to the piling of these parting agents on the contacting surfaces of the split die members, the accuracy thereof has lowered, which has caused the reduction in accuracy of resulting castings and the production of flashes therearound. To prevent these problems, conventionally, the parting agent stuck to the facing surfaces of the split die members has been removed by air blowing. However, a long air blowing time has been required, which has extended one casting cycle, and accordingly, lowered productivity.

Due to spraying, the die is suddenly cooled, which increases heat shock and shortens the lifetime of the die. Furthermore, if an excess of parting agent is applied, defective castings would be produced due to residual water.

In addition, the parting agent scattered due to spraying would contaminate the neibourhood of the die, which would worsen the working environment thereof.

To prevent these problems, it has been contemplated to spray the parting agent on die walls with split die members closed. This method, however, has different problems that, if a large amount of parting agent is sprayed to coat die walls having complex configurations completely, the solid lubricant precipitated and residual water would cause the production of defective castings and the increase in heat shock.

Furthermore, where particles having a large specific gravity, such as a solid lubricant, are used, the stably dispersing state would be difficult to maintain constantly even if the dispersing agent is used, thereby causing the precipitation of the solid lubricant. This would result in the concentration of the solid lubricant within the conventional parting agent becoming different between an upper part and a lower part of a casing enclosing the conventional parting agent. And when die walls are coated with the conventional parting agent which includes particles of the solid lubricant having a large specific gravity, the composition thereof would vary in accordance with the coated positions.

SUMMARY OF THE INVENTION

It is an object of the present invention to provide a parting agent for die-casting, which is capable of being applied to a die with split die members closed, preventing the production of defective castings and the occurrence of heat shock, and also preventing the precipitation of a solid lubricant.

A parting agent in accordance with a first aspect of the present invention is composed of a mixture of a parting component, a dispersing component adapted to disperse the parting component through water, a surface active agent as a foaming agent, and water, which is foamed into a foamy state.

With a second aspect of the present invention, the parting component of the first aspect includes at least one kind of oil selected from the group consisting of silicone oil, mineral oil, animal oil, vegetable oil, synthetic oil and wax, and the dispersing component of the first aspect includes an emulsifying agent adapted to emulsify and disperse the oil.

With a third aspect of the present invention, the parting component of the first aspect includes particles of at least one kind of a solid lubricant selected from the group consistng of graphite, molybdenum disulfide, talc, sericite, boron nitride, mica, graphite fluoride and fluorocarbon resin, and the dispersing component of the first aspect includes a dispersing agent for dispersing the particles of the solid lubricant.

With a fourth aspect of the present invention, the surface active agent of the first aspect is composed of at least one of an anionic surface active agent and a nonionic surface active agent.

As described above, the parting component is divided broadly into two kinds, one being oil such as silicone oil, mineral oil, vegetable oil, synthetic oil and wax, and the other being a solid lubricant such as graphite, molybdenum disulfide, talc, sericite, boron nitride, mica, graphite fluoride and fluorocarbon resin. One kind of parting component will do, and alternatively, two kinds of parting components may be used together.

Silicone oil is one kind of synthetic oil based on $(SiO)_n$, examples of which include dimethyl polysiloxane and denatured polysiloxane such as alkyl-denatured polysiloxane. Examples of mineral oil include turbine oil, machine oil, cylinder oil or the like which are obtained by the distillation of crude oil (petroleum). Animal oil and vegetable oil are respectively produced from living bodies. Examples thereof include beef tallow, lard, lanoline, castor oil, soybean oil and rape oil. Synthetic oil is produced by chemical synthesis. Examples thereof include α-olefin oil and diester oil. Examples of wax include natural wax such as Japan wax and beeswax, paraffin wax refined from petroleum, and polyethylene wax produced by chemical synthesis.

The solid lubricant is used in the form of particles. The preferred particle diameter is about 0.01 to 30 μm. When the particle diameter is less than 0.01 μm, the lubrication properties decrease, and when the particle diameter is greater than 30 μm, resulting casting surfaces become rough and accordingly the appearance quality thereof is deteriorated.

The above-described parting component enables the readily parting of a casting from a die because of excellent lubrication properties. The effective concentration of the parting component within a parting agent is about from 0.1 to 20% by weight. When the concentration of the parting component is less than 0.1% by weight, the lubrication properties are scarecely obtained so that the parting effect is difficult to achieve. When the concentration of the parting component exceeds 20% by weight, resulting casting surfaces are undesirably inferior and/or soiled due to the generation of soot and residue after combustion.

Oil is effective in the die-casting method of injecting molten metal at a high rate. This is caused by oil being excellent in both the lubrication properties and comformability to molten metal such as molten aluminum, and an oil film being formed on walls to make resulting casting surfaces better.

The solid lubricant is effective in the die-casting method of injecting molten metal at a low rate. This is caused by the solid lubricant serving as an insulating material adapted to restrain a temperature drop of molten metal such as molten aluminum upon injecting it at a low rate. Graphite exhibits a good effect on both the die-casting methods of injecting molten metal at a high rate and a low rate.

Where oil is used as the parting component, an emulsifying agent must be used as the dispersing component. Examples of the emulsifying agent include polyoxyethylene alkylallyl ether, polyoxyethylene alkyl ether and polyoxyethylene solbitane fatty acid ester. By virtue of the emulsifying agent, oil is emulsified and dispersed through water, whereby the separation of oil from water is prevented to ensure a homogeneous state. The preferred amount of the emulsifying agent within the parting agent ranges from 5 to 40% by weight of the amount of the effective components. When the amount of the emulsifying agent is less than the above range, the emulsification of oil becomes difficult and the separation from water may occur, and when the amount of emulsifying agent is greater than the above range, the emulsification effect is saturated to reduce the amount of remaining components, thus generating problems.

Where the solid lubricant is used as the parting component, a dispersing agent such as sodium carboxymethylcellulose, methylcellulose, met hylethylcellulose is used as the dispersing component. The preferred amount of the dispersing agent within the parting agent ranges from 1 to 30% by weight of the amount of effective components. When the amount of the dispersing agent is less than the above range, the solid lubricant may precipitate, and when the amount of the dispersing agent is greater than the above range, the dispersing effect is saturated to reduce the amount of remaining components, thus generating problems.

Oil and the solid lubricant can be used together as the parting component. In this case, the emulsifying agent and dispersing agent must be used together as the dispersing component.

The surface active agent serves to foam a liquid dispersion including the parting component and dispersing component into a foamy state, and is selected from the group consisting of an anionic surface active agent having excellent foaming properties, such as potassium oleate, sodium laurylsulfate, triethanolamine laurylsulfate, ammonium laurylsulfate, sodium polyoxyethylene laurylsulfate, and lauryl alcohol ether sulfate (salt of sodium), a nonionic surface active agent such as polyoxyethylene nonyl phenyl eter (HLB about 15), and various derivatives thereof.

The effective amount of the surface active agent ranges from 0.1 to 10% by weight of the parting agent. When the amount of the surface active agent is less than 0.1% by weight, the foaming of the parting agent is difficult, and when the amount of the surface active agent is greater than 10% by weight, the foaming effect is saturated to reduce the amount of remaining components, thus generating problems.

It is preferable that the surface active agent used has the following characteristics:

(a) It is readily foamable.

(b) It does not block the emulsifying state of the oil and dispersing state of the solid lubricant.

(c) It can maintain the foamy state of the parting agent until charging a die.

(d) It is speedily defoamable at the moment of contacting a die of about 150° to 250° C.

(e) It does not define blocking factors for the lubrication properties and parting properties.

The parting agent can include a foaming component such as a salt of fatty acid, an extreme pressure agent such as zinc dialkyl dithiophosphate, or other component.

The preferred foam size is 5 mm or less. When the foam size is greater than 5 mm, the retention of foam lowers to be likely to defoam, which may disenable the uniform coating on die walls.

The preferred volume of air to be mixed for foaming ranges from 7 to 30 times as large as that of the liquid parting agent. When the volume of air is less than the above range, the foaming of the parting agent becomes difficult, and when the volume of air is greater than the above range, resulting foam becomes large to be likely to defoam.

The parting agent thus prepared is, first, foamed by bubbling with air, stirring forcedly, mixing air into a static mixer, or other method, and a die closed is charged with the parting agent while maintaining the foamy state thereof with a pushing force of air or a piston. When the charging is completed, extraneous foam is discharged from the die with air blow or suction under a reduced pressure.

Since the parting agent of the present invention is in a foamy state, no spraying operation is needed to charge the die with the parting agent. Accordingly, there does not occur the problem caused by the scattering of the parting agent sprayed. Since the parting agent sticks to die walls in a foamy state, the amount of water contacting the die walls per unit time is small, as compared to that in cases of the spraying method. This prevents the occurrence of heat shock in the die and enables the extension of the lifetime thereof.

Furthermore, with the parting agent of the present invention, the parting component is retained by a film defining foam, which prevents the separation and precipitation of the parting component. Accordingly, the parting component sticks to the entire die walls with uniformity to ensure uniform parting properties. Since the parting agent is in a foamy state, the removal and recovery of extraneous parting agent are easy, which prevents problems caused by residual water, and improves the yield of the parting agent, as compared to the conventional spraying method.

Other objects, features, and characteristics of the present invention will become apparent upon consideration of the following description and the appended claims with reference to the accompanying drawings, all of which form a part of this specification.

DETAILED DESCRIPTION OF THE PRESENTLY PREFERRED EXEMPLARY EMBODIMENTS

Figure 1:
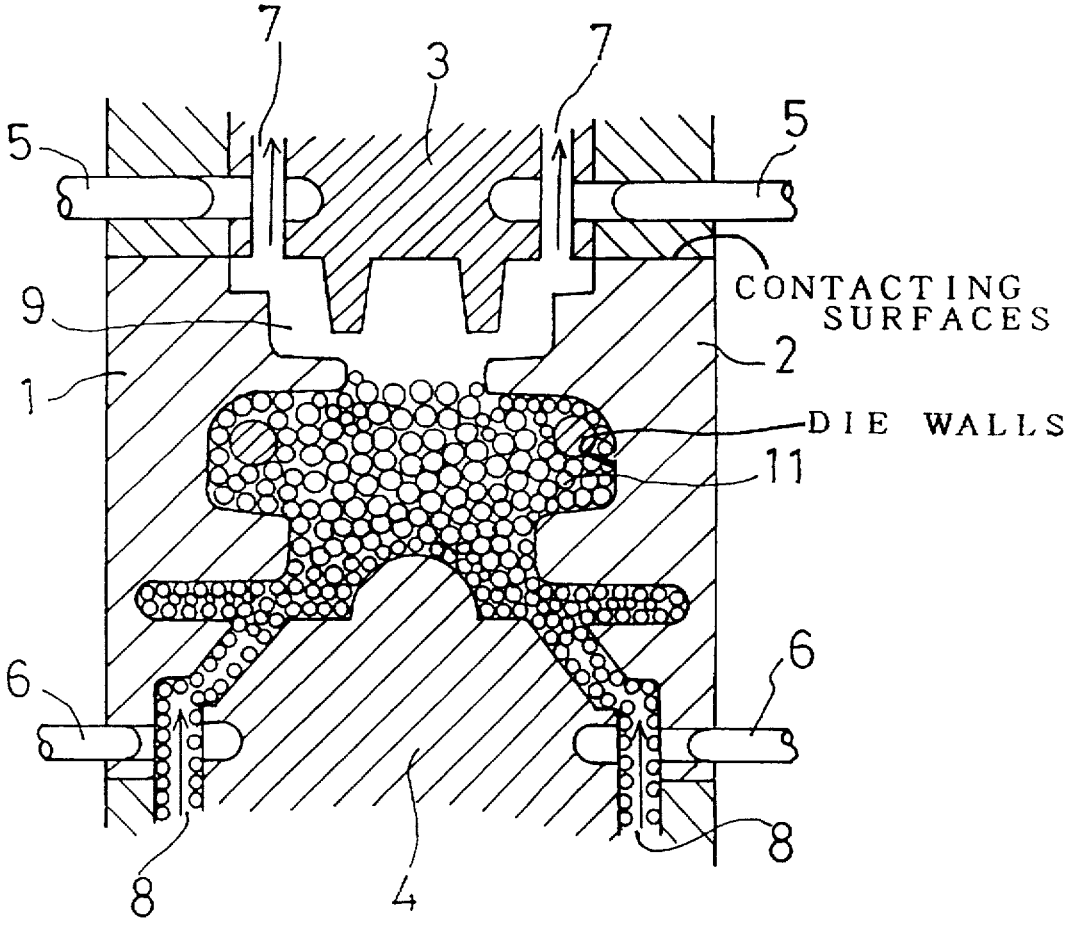
FIG. 1 is a cross-sectional view of a die which is charged with an embodiment of a parting agent in accordance with the present invention.

Hereinafter, embodiments of the present invention will be explained with reference to the accompanying drawing.

Alkyl-denatured silicone oil, cylinder oil, polyethylene wax and powders of graphite, sericite and boron nitride were respectively prepared as the parting component.

20 parts by weight of each oil was added to 5 parts by weight of polyoxyethylene alkylallyl ether as an emulsifying agent. The mixtures thus prepared were stirred thoroughly, and 75 parts by weight of water was further added respectively and stirred thoroughly by means of a homogenizer, thus preparing emulsions including oils described above, respectively.

20 parts by weight of each of powders of graphite, sericite and boron nitride was gradually added to 80 parts by weight of a solution wherein 2% by weight of carboxymethylcellulose as a dispersing agent dissolved, while stirring thoroughly, thus preparing dispersions through which solid lubricants described above are respectively dispersed.

Triethanolamine laurylsulfate, sodium laurylsulfate and lauryl alcohol ether sulfate (salt of sodium) were prepared as a surface active agent, and they were respectively diluted with water to a concentration of 20% by weight, thus preparing surface active agent solutions.

Each emulsion, each dispersion and each surface active agent solution were mixed together such that the parting component and surface active agent therein had a weight ratio shown in TABLE 1. Resulting mixture liquids were respectively supplied to a static mixer along with air and then foam was produced in the mixing ratio shown in TABLE 1, thus preparing parting agents of Embodiments 1–10.

These parting agents respectively foamed into a homogeneous foamy state of which the foam diameter was about 0.1 to 2 mm.

Each parting agent was applied to a die as follows: As shown in FIG. 1, a die includes a fixed die member 1, a movable die member 2, and slide cores 3 and 4. The fixed die member 1 and movable die member 2 are clamped, and the slide cores 3 and 4 are slid for clamping, thus sealing the resulting die and defining a cavity 9 within the die.

To apply a parting agent to the die thus prepared, first, the die is sealed as described above, and then, while upper and lower pins 5 and 6 are respectively opened to evaculate the cavity 9 by way of passages 7, each parting agent 11 foamed is supplied into the cavity 9 by way of passages 8 with the use of a pushing force of a piston of a cylinder device (not shown), thus charging the cavity 9 with the foamy parting agent 11. The die was temporarily opened and the charging state of each parting agent was examined. Examination results showed that the cavity 9 was charged uniformly with each parting agent. The temperature of walls of the die was 100° to 180° C.

The die was closed again, and extraneous parting agent was discharged from the die by an air blower. Then, the die was opened temporarily and discharging state and residing state therein were examined. Examination results showed that each parting agent was readily discharged without remaining locally in an interior of the die.

Then, with the die closed, molten aluminum (ADC 12) of 680° C. was injected into the die at a rate of 1.6 to 1.8 m/s by means of a horizontal casting device of 2000 t. After resulting castings were cooled to 330° C., the die was opened to part them from the die. Then, the parting resistance of each casting was measured and the appearance thereof was visually judged. The results are shown in TABLE 1. The appearance of each casting was evaluated with ten ranks.

A conventional parting agent composed of silicone oil, mineral oil and vegetable oil was sprayed on a die with the arrangement similar to that of the embodiments of the present invention. Then, the parting resistance and appearance were similarly evaluated and shown in TABLE 1 as a conventional example.

TABLE 1

| | Embodiments | | | | | | | | | | Conventional |
|---|---|---|---|---|---|---|---|---|---|---|---|
| | 1 | 2 | 3 | 4 | 5 | 6 | 7 | 8 | 9 | 10 | Example |
| alkyl-denatured silicone oil | | 80 | | 27 | 40 | 25 | 40 | | | | parting agent on the market, composed of silicone oil, mineral oil and vegetable oil |
| cylinder oil | | | 80 | 26 | 40 | 25 | 10 | | | | |
| polyethylene wax | | | | 26 | | | | | | 80 | |
| graphite | 80 | | | | | | | | | | |
| sericite | | | | | | | | 80 | 75 | | |
| boron nitride | | | | | | | | | 5 | | |
| laurylsulfate triethanolamine | | | 20 | | | | | | 20 | 20 | |
| sodium laurylsulfate | 20 | | | 20 | | | | 20 | | | |
| lauryl alcohol ether sulfate | | 20 | | | 20 | 50 | 50 | | | | |
| air/mixture liquid (volume ratio) | 10 — 20 | 10 — 20 | 10 — 20 | 15 — 20 | 15 — 20 | 20 — 30 | 20 — 30 | 10 — 20 | 10 — 20 | 10 — 20 | — |
| parting resistance (kgf/cm$^2$) | 27 | 30 | 31 | 35 | 28 | 30 | 28 | 70 | 55 | 43 | 35 |
| appearance (10 ranks evaluation 10 good ← → bad 1) | 5 | 6 | — | 6 | 7 | 8 | 8 | 2 | 2 | — | 6 |

As is apparent from TABLE 1, both the parting resistance and appearance depend on the combination of components. The parting resistances of Embodiments 1–7 of the present invention were 40 kgf/cm$^2$ or less, and the ranks of the appearance thereof were 5 or more. These results show that the parting agents of the embodiments of the present invention exhibit good parting properties similar to those of the conventional example.

Furthermore, it has been confirmed that, with the parting agent of the present embodiment, the die was coated with the parting component uniformly without a local increase in parting resistance.

The parting agent of the present invention does not require any spraying operation, which prevents the worsening of the working environment due to the scattering of the parting agent, and also increases the yield thereof. Furthermore, the parting agent of the present invention can be applied with a die closed, which prevents the sticking and piling of the parting agent on contacting surfaces of split die members so that the conventionally required air blowing time can be shortened and the production of flashes can be prevented, thus improving the accuracy of the configuration of the resulting castings.

Since particles having large specific gravities, such as solid lubricants, can be retained with foam, the precipitation thereof can be prevented. And the foamy state of the parting agent facilicates the separation, movement and removal of extraneous parting agent, and enables a resulting foamy parting agent layer on die walls to have an approximately constant thickness. This enables the uniform coating of the parting component and prevents the occurrence of heat shock, whereby the lifetime of the die can be prolonged. In addition, by adjusting both the diameter of foam and the content of water, the cooling effect can be controlled.

Conventionally, to ensure the coating with spraying, solid lubricants having smaller particle diameters have been required. In contrast, with the present invention, the solid lubricants having larger particle diameters can be used, which enables improvements of both the lubrication effect and parting properties.

While the invention has been described in connection with what are considered presently to be the most practical and preferred embodiments, it is to be understood that the invention is not limited to the disclosed embodiments, but, on the contrary, is intended to cover various modifications and equivalent arrangements included within the spirit and scope of the appended claims.

What is claimed is:

1. A parting agent for die-casting, comprising:

a parting component;

a dispersing component for dispersing said parting component through water; and a surface active agent as a foaming agent, said parting component, said dispersing component and said surface active agent being mixed with water and foamed into a foamy state.

2. A parting agent as claimed in claim 1, wherein said parting component is contained in an amount ranging from 0.1 to 20% by weight of said parting agent.

3. A parting agent as claimed in claim 1, wherein said surface active agent is contained in an amount ranging from 0.1 to 10% by weight of said parting agent.

4. A parting agent as claimed in claim 1, wherein the foam size is 5 mm or less.

5. A parting agent as claimed in claim 1, wherein the volume of air to be mixed for foaming ranges from 7 to 30 times as large as that of said parting agent.

6. A parting agent as claimed in claim 1, wherein said parting component includes at least one kind of oil selected from the group consisting of silicone oil, mineral oil, animal oil, vegetable oil, synthetic oil and wax, and said dispersing component inclues an emulsifying agent for emulsifying and dispersing said oil.

7. A parting agent as claimed in claim 6, wherein said emulsifying agent is contained in an amount ranging from 5 to 40% by weight of said parting agent.

8. A parting agent as claimed in claim 1, wherein said parting component includes particles of at least one kind of a solid lubricant selected from the group consisting of graphite, molybdenum disulfide, talc, sericite, boron nitride, mica, graphite fluoride and fluorocarbon resin, and said dispersing component includes a dispersing agent for dispersing said particles of at least one kind of solid lubricant.

9. A parting agent as claimed in claim 8, wherein the particle diameter of said solid lubricant is 0.01 to 30 μm.

10. A parting agent as claimed in claim 8, wherein said dispersing agent is contained in an amount ranging from 1 to 30% by weight of said parting agent.

11. A parting agent as claimed in claim 1, 6, or 8, wherein said surface active agent is at least one of an anionic surface active agent and a nonionic surface active agent.

12. A parting agent as claimed in claim 11, wherein said anionic surface active agent is at least one selected from the group consisting of potassium oleate, sodium laurylsulfate, triethanolamine laurlysulfate, ammonium laurylsulfate, sodium polyoxyethylene laurylsulfate, and sodium lauryl alcohol ether sulfate.

* * * * *